US007614626B1

(12) United States Patent
Aanerud et al.

(10) Patent No.: US 7,614,626 B1
(45) Date of Patent: Nov. 10, 2009

(54) MOVING TARGET SYSTEM

(76) Inventors: Richard R. Aanerud, 211 N. 10th St., Montevideo, MN (US) 56265; Laura A. Aanerud, 211 N. 10th St., Montevideo, MN (US) 56265

( * ) Notice: Subject to any disclaimer, the term of this patent is extended or adjusted under 35 U.S.C. 154(b) by 0 days.

(21) Appl. No.: 12/110,947

(22) Filed: Apr. 28, 2008

Related U.S. Application Data

(60) Provisional application No. 60/951,064, filed on Jul. 20, 2007.

(51) Int. Cl.
*F41J 9/00* (2006.01)

(52) U.S. Cl. ..... 273/367; 273/366; 273/406; 273/407

(58) Field of Classification Search ..... 273/359, 273/366–370, 390–392, 404–410, 395
See application file for complete search history.

(56) References Cited

U.S. PATENT DOCUMENTS 547,141 A * 10/1895 Crutchfield ..... 273/366
811,636 A * 2/1906 Herold ..... 273/366
1,075,518 A * 10/1913 Thresher ..... 273/359
1,557,834 A * 10/1925 Hassig ..... 446/246
2,290,297 A * 7/1942 Smith ..... 273/370
2,494,210 A * 1/1950 Robinson ..... 273/369
2,703,240 A * 3/1955 Flory ..... 273/370
3,363,900 A * 1/1968 Cadle ..... 273/359
3,471,153 A * 10/1969 Baumler ..... 273/359
4,081,056 A * 3/1978 Siitonen ..... 185/6
4,738,223 A * 4/1988 Andreasen ..... 119/839
5,031,497 A * 7/1991 Moshier et al. ..... 83/168
5,367,238 A 11/1994 Sakamoto et al.
5,816,579 A * 10/1998 Broussard et al. ..... 273/408
6,053,305 A * 4/2000 Helmerson ..... 198/817
6,736,400 B1 5/2004 Cesternino

FOREIGN PATENT DOCUMENTS

CH 660782 A * 6/1987

* cited by examiner

*Primary Examiner*—Mark S Graham

(57) ABSTRACT

A moving target system for efficiently improving the accuracy of a shooter. The moving target system generally includes a first outer support, a second outer support, wherein the second outer support is distally spaced from the first outer support and a conveyor system supported by the first outer support and the second outer support, wherein the conveyor system is adapted for movement in an endless loop. A power supply is connected to the conveyor system, wherein the power supply is adapted to move the conveyor system. At least one target is also attached to the conveyor system, wherein the at least one target moves with the conveyor system along the endless loop.

10 Claims, 5 Drawing Sheets

MOVING TARGET SYSTEM

CROSS REFERENCE TO RELATED APPLICATIONS

I hereby claim benefit under Title 35, United States Code, Section 119(e) of U.S. provisional patent application Ser. No. 60/951,064 filed Jul. 20, 2007. The 60/951,064 application is currently pending. The 60/951,064 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to targets and more specifically it relates to a moving target system for efficiently improving the accuracy of a shooter.

2. Description of the Related Art

Any discussion of the related art throughout the specification should in no way be considered as an admission that such related art is widely known or forms part of common general knowledge in the field.

Targets have been in use for years and are utilized by various types of sportsman to improve their accuracy, shooting skills or simply for the enjoyment of the sport. Targets generally come in various shapes and sizes to adapt to the particular purpose that the shooter is utilizing the target for.

One of the main problems with targets is that the target is generally stationary. A stationary target may not challenge the shooter properly or prepare the shooter for real life situations, wherein if the shooter is a practicing for hunting sake it may be a great advantage to practice on a moving target. Because of the inherent problems with the related art, there is a need for a new and improved moving target system for efficiently improving the accuracy of a shooter.

BRIEF SUMMARY OF THE INVENTION

The general purpose of the present invention is to provide a moving target system that has many of the advantages of the targets mentioned heretofore. The invention generally relates to a target which includes a first outer support, a second outer support, wherein the second outer support is distally spaced from the first outer support and a conveyor system supported by the first outer support and the second outer support, wherein the conveyor system is adapted for movement in an endless loop. A power supply is connected to the conveyor system, wherein the power supply is adapted to move the conveyor system. At least one target is also attached to the conveyor system, wherein the at least one target moves with the conveyor system along the endless loop There has thus been outlined, rather broadly some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a moving target system for efficiently improving the accuracy of a shooter.

Another object is to provide a moving target system that continuously moves while in operation to provide a challenging shooting target for shooter.

An additional object is to provide a moving target system that is easy to set up and may be set up on various types of surfaces.

A further object is to provide a moving target system that remains stable while shooting at the targets.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
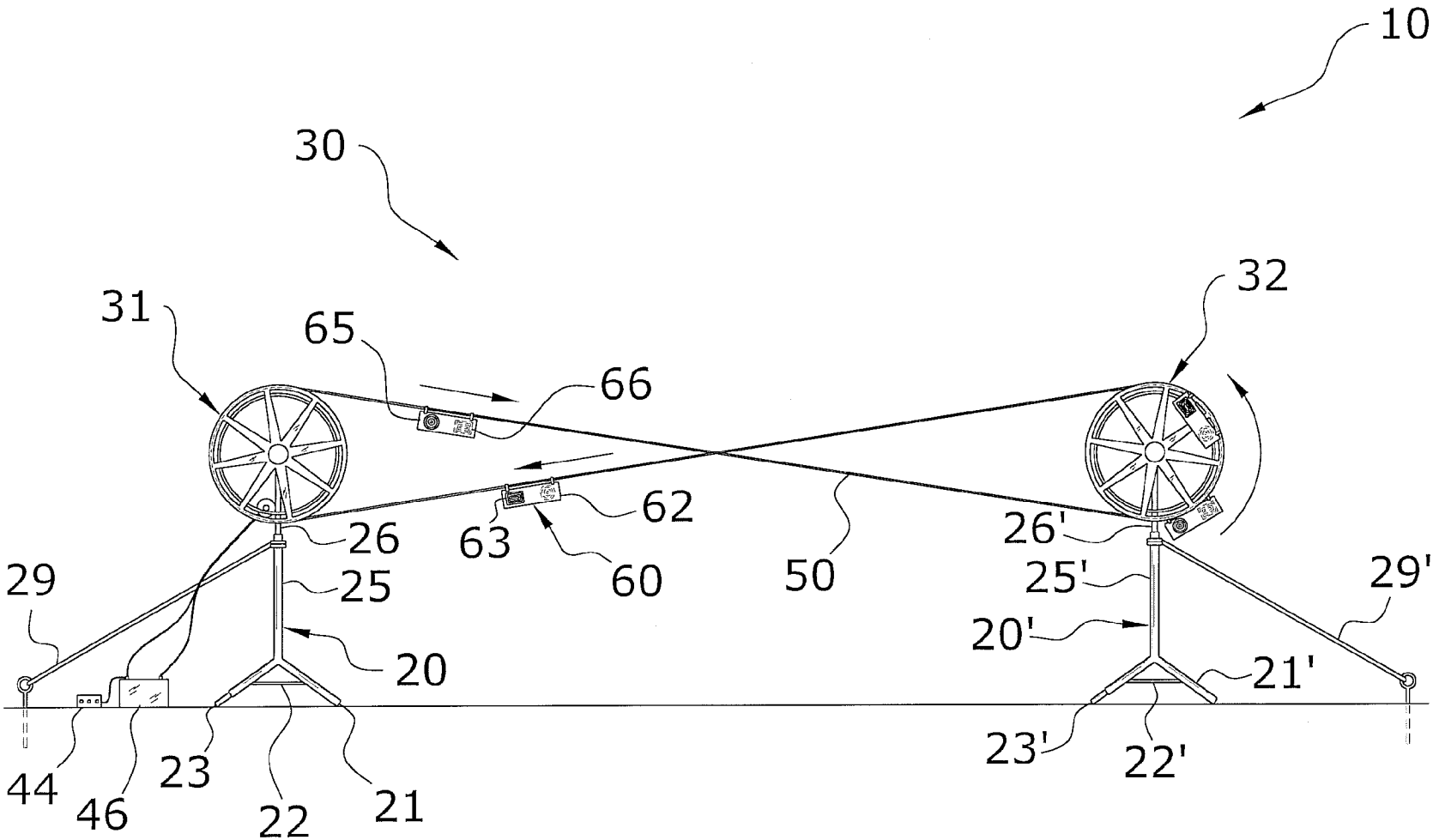
FIG. 1 is a front view of the present invention, wherein the targets are moving along the circulation path of the elongated member.

Turning now descriptively to the drawings, in which similar reference characters denote similar elements throughout the several views, FIGS. 1 through 5 illustrate a moving target system 10, which comprises a first outer support 20 including a drive wheel 31, wherein the drive wheel 31 is rotated via a power supply 40 and a second outer support 20' including an idler wheel 32 distally spaced from the first outer support 20. An elongated member 50 extends between the drive wheel 31 and the idler wheel 32 and follows a figure-eight circulation path between thereof via the drive wheel 31. A target 60 extends from the elongated member 50 and follows the circulation path of the elongated member 50.

B. Outer Support

Figure 2:
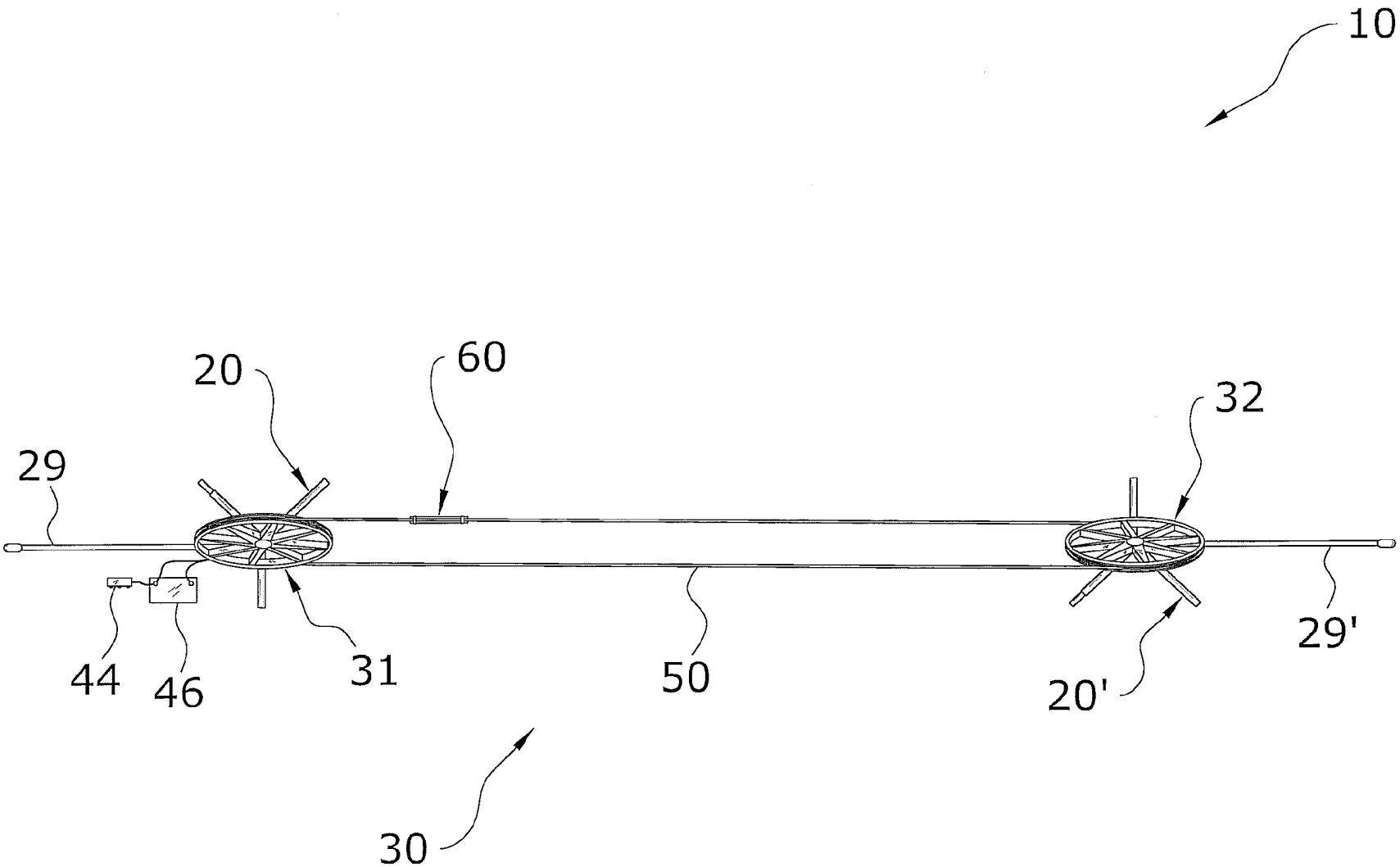
FIG. 2 is a top view of the present invention.
Figure 3:
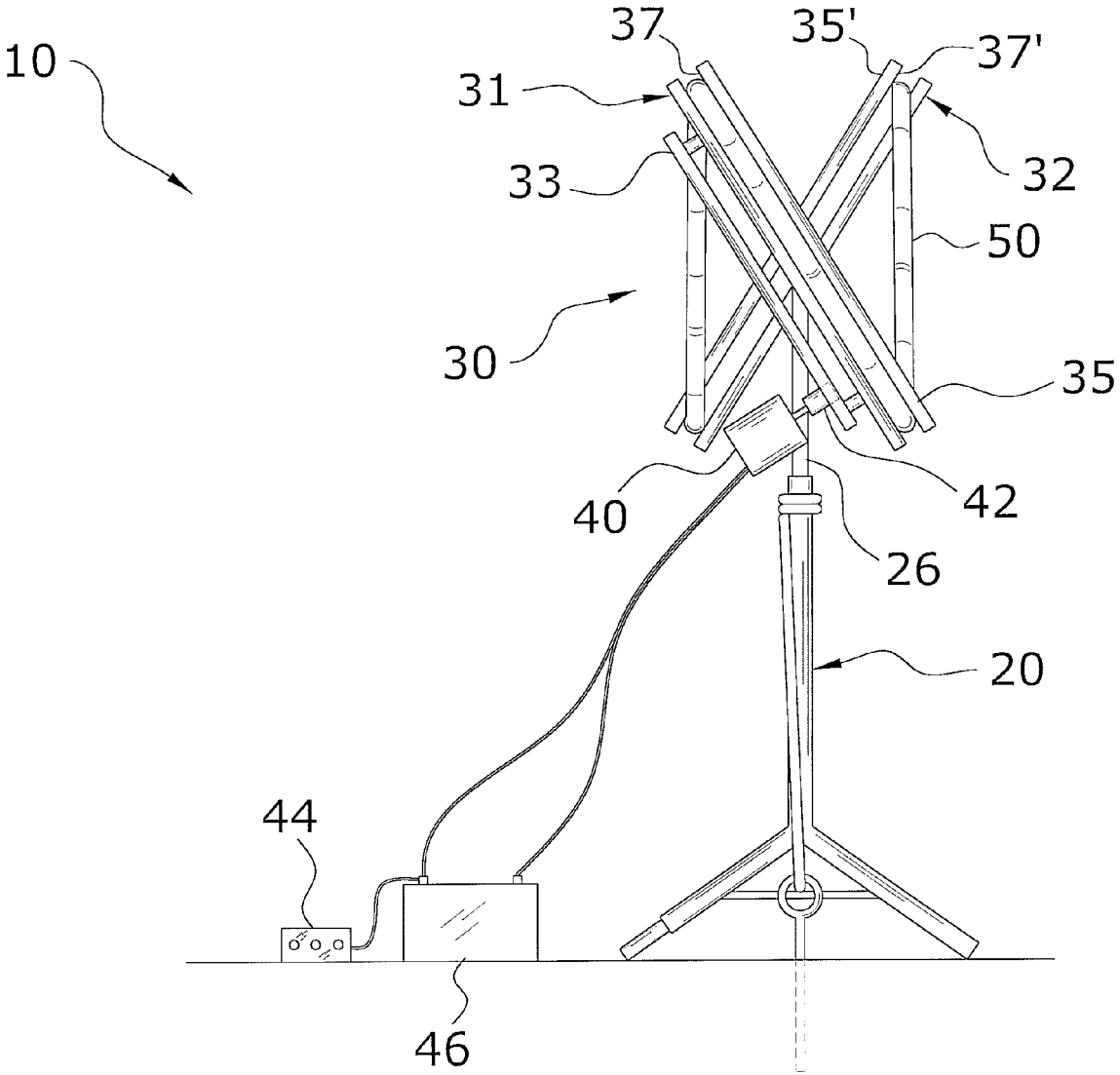
FIG. 3 is a side view of the present invention.
Figure 4:
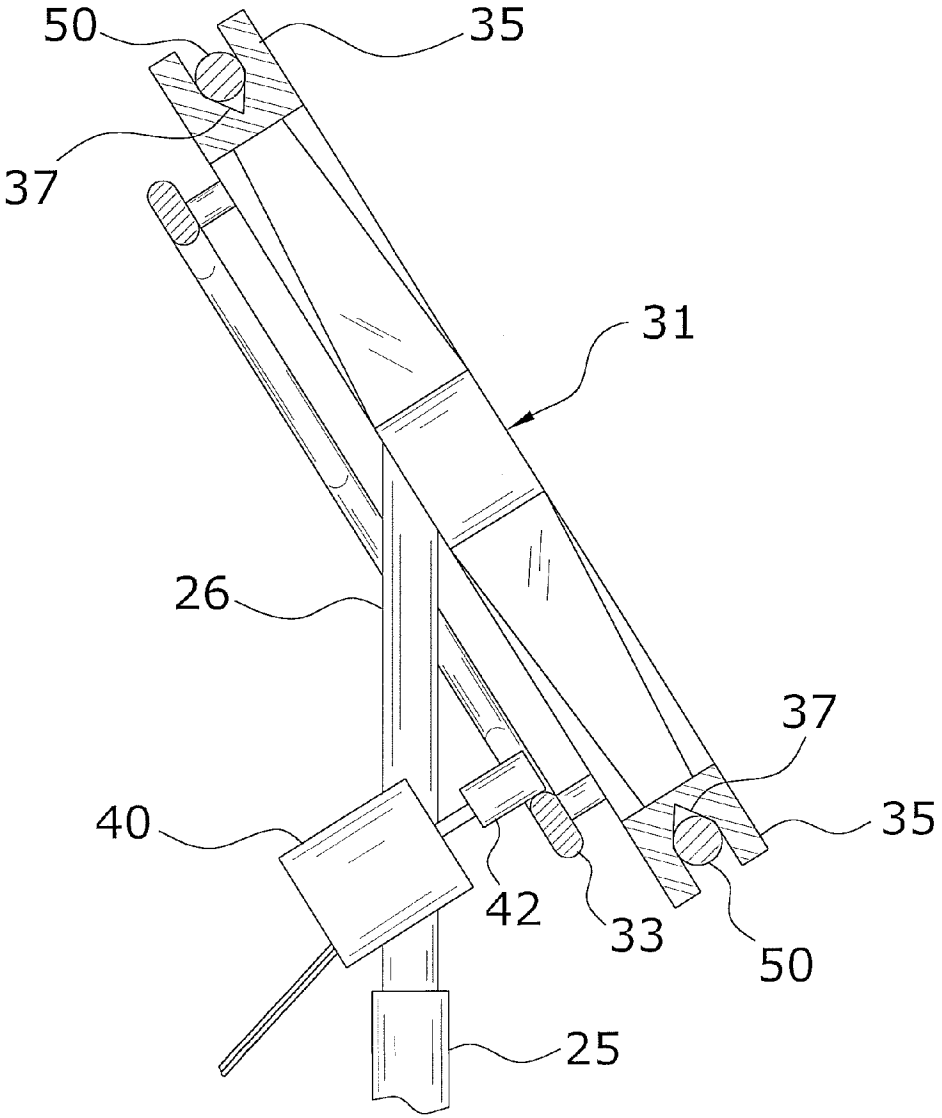
FIG. 4 is a cross-sectional view of the drive wheel with the elongated member and the power supply engaging the drive wheel.
Figure 5:
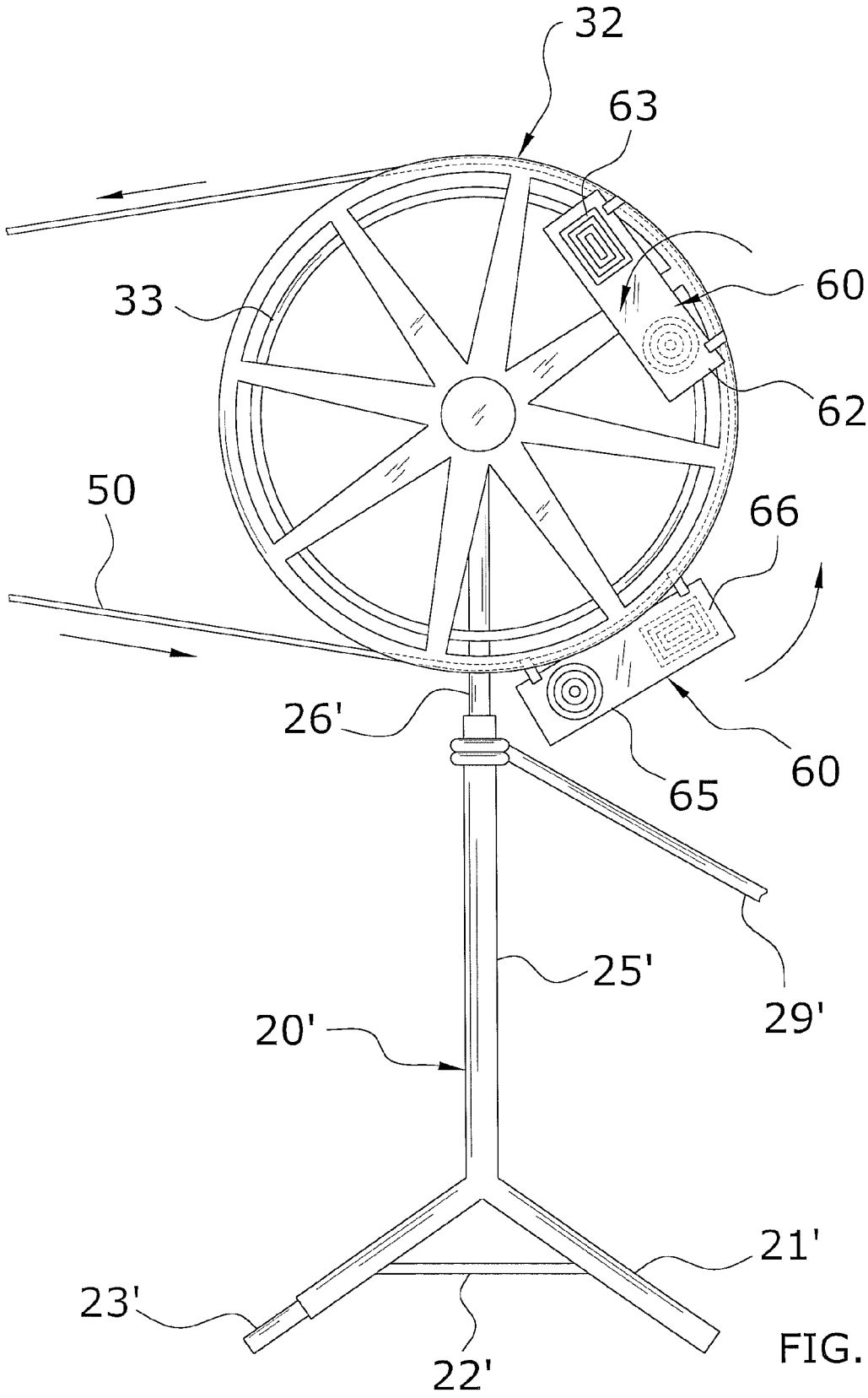
FIG. 5 is a sides view of one of the outer supports illustrating the target flipping over while traveling around the wheel.

The outer supports 20, 20' to support the drive wheel 31 and the idler wheel 32 are preferably comprised of substantially similar structures as illustrated in FIGS. 1 through 3. The outer supports 20, 20' are comprised of a self-standing and supporting structure, wherein the outer supports 20, 20' may be positioned in open areas (e.g. fields, etc.) without the aid of other supports (e.g. buildings, trees, etc.).

The outer supports 20, 20' are preferably comprised of a substantially durable and strong structure, wherein the outer support 20, 20' is able to withstand harsh weather elements and also withstand a bullet (i.e. from the shooter) applying a substantial force upon the target 60. The outer support 20, 20' may further be comprised of various materials, such as but not limited to metal, plastic or wood.

The outer support 20, 20' includes an upper support 25, 25' vertically extending upwards as illustrated in FIGS. 1 through 3. Extending from the lower end of the upper support 25, 25' are preferably a plurality of legs 21, 21'. The legs 21, 21' preferably extend from the lower end of the upper support 25, 25' at a downward angle and are comprised of a tripod configuration. It is appreciated however that the present invention may include various configurations of legs 21, 21' to stabilize the present invention about the ground surface.

Each of the legs 21, 21' may also include a lower support 22, 22' substantially horizontally extending between the lower end of the upper support 25, 25' and the legs 21, 21'. The lower supports 22, 22' preferably add additional support to the legs 21, 21' between the upper support 25, 25' and the legs 21, 21'. At least one of the legs 21, 21' may also include an adjustment member 23, 23' as illustrated in FIGS. 1 through 3. The adjustment member 23, 23' preferably telescopes out from at least one of the legs 21, 21' to ensure that the legs 21, 21' are stabilized upon the ground (i.e. when the legs 21, 21' are upon an uneven ground surface).

A telescoping member 26, 26' preferably extends within the upper support 25, 25' as illustrated in FIGS. 1 through 4. The telescoping member 26, 26' extends from the upper end of the upper support 25, 25'. The telescoping member 26, 26' allows for the adjustment of the height of the wheels 31, 32 and thus target 60. The telescoping member 26, 26' may be secured at a specific vertical height about the upper support 25, 25' via various manners (e.g. pin, etc.).

It is appreciated that the outer support 20, 20' may be comprised of a foldable structure to allow for easier storage of the present invention during nonuse. It is also appreciated that the outer support 20, 20' may be comprised of a rigid and fixed structure to add further stability to the outer support 20, 20'.

A bracket is also preferably attached upon the upper end of the telescoping member 26, 26'. The bracket serves as an interconnecting member between the telescoping member 26, 26' and the wheel 31, 32. The bracket is also preferably formed to attach the wheel 31, 32 at a sloped angle with respect to the longitudinal axis of the outer support 20, 20'. The bracket may be comprised of various configurations all which efficiently secure the wheel 31, 32 to the outer support 20, 20'.

An external support 29, 29' may also be attached and extend from each of the outer supports 20, 20' as illustrated in FIGS. 1 through 3. The external support 29, 29' applies an outward force upon the outer support 20, 20' to ensure the elongated member 50 maintains a substantially taut configuration between the drive wheel 31 and the idler wheel 32. The external support 29, 29 may be comprised of various configurations, all which assist in maintaining a taut elongated member 50 between the drive wheel 31 and the idler wheel 32.

C. Conveyor System

The present invention includes a conveyor system 30 to move the targets 60 around and between the outer supports 20, 20'. The conveyor system 30 is comprised to function in an endless loop type manner. The conveyor system 30 may be comprised of various configurations all which convey the targets 60 in a continuous manner. In the preferred embodiment, the conveyor system 30 includes a drive wheel 31, an idler wheel 32, an elongated member 50 and all associated components to convey the conveyor system 30.

The conveyor system 30 is supported by the first outer support 20 and the second outer support 20', wherein the conveyor system 30 is adapted for movement in an endless loop around the first outer support 20 and the second outer support 20'. The conveyor system 30 is circulated via the power supply 40 connected to the conveyor system 30. The conveyor system 30 further preferably forms a figure-eight circulation path.

D. Wheels

The wheels 31, 32 of the conveyor system 30 preferably include a drive wheel 31 and at least one idler wheel 32 as illustrated in FIGS. 1 through 3. In the preferred embodiment, the present invention utilizes one idler wheel 32; however it is appreciated that the present invention may include multiple idler wheels 32 when the outer supports 20, 20' are distally spaced over extended distances or around corners. The wheels 31, 32 may be comprised of various materials, such as but not limited to plastic or metal.

Each of the wheels 31, 32 are preferably positioned at a sloped angle with respect to the longitudinal axis of the outer support 20, 20'. The sloped angle assists the target 60 in traveling over and around the wheel during the circulation path of the target 60 and the elongated member 50. The sloped angle of the wheels 31, 32 also assists in maintaining a taut elongated member 50 and forming the figure-eight configuration in the elongated member 50 (i.e. when the wheels 31, 32 are angled in opposing directions).

Opposing outer supports 20, 20' are also preferably positioned so that the drive wheel 31 and the idler wheel 32 are sloped in opposing directions as illustrated in FIGS. 2 and 3. The opposing sloped angles of the drive wheel 31 and the idler wheel 32 help to maintain a taut elongated member 50.

The wheels 31, 32 each preferably includes a hub rotatably attached to the bracket. The hub is preferably able to freely spin about the bracket or telescoping member 26, 26' via a shaft extending between thereof. It is appreciated that the wheels 31, 32 may include bearings to assist the wheels 31, 32 in spinning freely about the outer support 20, 20'. Each of the wheels 31, 32 also include a receiving portion 35, 35' extending around a perimeter of the wheels 31, 32 and a groove 37, 37' extending within the receiving portion 35, 35'.

The groove 37, 37' is preferably comprised of a V-shape and receives the elongated member 50. The V-shape of the groove 37, 37' helps to secure the elongated member 50 within the groove 37, 37' of the wheel 31, 32. The receiving portion 35, 35' is also preferably supported about the hub via a plurality of spokes as illustrated in FIGS. 1 and 2. It is appreciated however that the wheels 31, 32 may include a solid disc-like structure between the hub and the receiving portion 35, 35'.

The drive wheel 31 also includes an engaging portion 33 extending around the perimeter of the drive wheel 31. The engaging portion 33 preferably extends around the inner side of the perimeter adjacent the outer support 20. The engaging portion 33 engages the drive member 42 of the power supply 40, wherein the drive member 42 rotates about the engaging portion 33 to rotate the drive wheel 31 in a friction engaging manner. It is appreciated that the idler wheel 32 may also include the engaging portion 33, wherein the drive wheel 31 and the idler wheel 32 may be interchangeable.

E. Power Supply

The power supply 40 is preferably attached to the outer support 20, 20' adjacent the drive wheel 31. In the preferred embodiment, the power supply 40 is comprised of an electric driven motor 40; however it is appreciated that the power supply 40 may be comprised of various configurations, such as but not limited to a gasoline driven motor 40. The power supply 40 circulates the elongated member 50 of the conveyor system 30 via rotating the drive wheel 31.

Extending from the power supply 40 is a drive member 42, wherein the drive member 42 rotates and engages the engaging portion 33 of the drive wheel 31. The drive member 42 rotates the drive wheel 31 via rotating about the engaging portion 33 of the drive wheel 31. The drive member 42 and the drive wheel 31 further preferably operate in a similar manner as a gear rotating an internal ring gear common in the art.

The power supply 40 is powered via a power supply 46 (e.g. battery). The power supply 46 in the present invention is comprised of a battery and may be further comprised of various size batteries (i.e. 6 volt, 12 volt, etc.); however it is appreciated that the power supply 40 may operate via various types of power supplies 46 rather than the preferred embodiment.

A control system 44 is also preferably electrically connected between the power supply 46 and the power supply 40. The control system 44 allows a user to control the rotational speed of the drive member 42 and the thus rotational speed of the drive wheel 31 and subsequently speed of the target 60. The control system 44 may be comprised of various configurations, such as but not limited to a pulse width modulator. The control system 44 may also include an on/off switch.

F. Elongated Member

The elongated extends between the drive wheel 31 and the idler wheel 32. The elongated member 50 also extends substantially around the drive wheel 31 and the idler wheel 32 and is positioned within the groove 37, 37' of the receiving portions 35, 35' of the wheels 31, 32. The elongated member 50 may be comprised of various materials, such as but not limited to string, rope, a strap or various others.

The elongated member 50 is preferably substantially thin, so as to reduce the chances of the shooter hitting the elongated member 50 when shooting at the target 60. The elongated member 50 also preferably forms a figure-eight configuration between the drive wheel 31 and the idler wheel 32 as illustrated in FIGS. 1 and 2.

G. Target

The target 60 is attached to the elongated member 50 and travels along the circulation path of the elongated member 50. The target 60 is preferably attached to the elongated member 50 in a manner in which to allow the target 60 to swivel about the elongated member 50 (i.e. may include various connecting members between thereof).

The target 60 also includes a first target portion 63 upon a first side 62 of the target 60 and a second target portion 66 upon a second side 65 of the target 60 as illustrated in FIG. 1. The target 60 includes target portions 63, 66 upon each of the sides 62, 65 of the target 60 so that the target 60 may flip over upon traveling around a respective wheel 31, 32. The target 60 may include various types of target portions 63, 66 (e.g. bulls eye, etc.).

H. Operation of Preferred Embodiment

In use, the control system 44 is first turned on and/or the power supply 40 is connected to the power supply 46 thus powering the drive member 42 and rotating the wheels 31, 32. The target 60 now travels along the circulation path of the elongated member 50 and the shooter may shoot at the target 60. When the target 60 engages either wheel 31, 32, the target 60 is able to swivel or pivot about the elongated member 50.

As illustrated in FIG. 1, where the target 60 goes around the upper end of the wheel 31, 32 then the target 60 flips over thus exposing the alternate side 62, 65 of the target 60 to the shooter. The target 60 thus exposes a first side 62 to the shooter when moving in a first forward direction and a second side to the shooter 65 when moving in a second forward direction, wherein the first forward direction is different and preferably completely opposite the second forward direction. The shooter may then continue to aim and shoot at the target 60. At any time the shooter may adjust the speed of the target 60 along the circulation path via adjusting the control system 44.

The target 60 continues to travel along the circulation path in a fluid motion until the power is disconnected (i.e. disconnects battery, shuts off control system 44) from the power supply 40. It is also appreciated that a new target 60 or multiple targets 60 may be attached to the elongated member 50.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A moving target system, comprising:

a first outer support;

a second outer support, wherein said second outer support is distally spaced from said first outer support;

a conveyor system supported by said first outer support and said second outer support, wherein said conveyor system is adapted for movement in an endless loop;

wherein said conveyor system forms a figure-eight circulation path;

a power supply connected to said conveyor system, wherein said power supply is adapted to move said conveyor system; and at least one target connected to said conveyor system, wherein said at least one target moves with said conveyor system along said endless loop;

wherein said conveyor system includes a drive wheel, an idler wheel and an elongated member circulated around said drive wheel and said idler wheel;

wherein said elongated member forms a figure-eight circulation path;

wherein said drive wheel and said idler wheel include a V-shaped groove to receive said elongated member;

wherein said at least one target is pivotally connected to said conveyor system;

wherein said target includes a first side including a first target portion and a second side including a second target portion;

wherein said target is adapted to flip over from said first side to said second side when changing from a first direction to a second direction;

wherein said first direction is different than said second direction;

wherein said first outer support and said second outer support are comprised of self-supporting structures;

wherein said first outer support and said second outer support are comprised of telescoping structures;

wherein said first outer support and said second outer support are comprised of substantially similar configurations;

wherein said first outer support and said second outer support include a tripod configuration; and a control system electrically connected to said power supply;

wherein said control system is adapted to change a speed of said conveyor system.

2. A moving target system, comprising:

a first outer support;

a second outer support, wherein said second outer support is distally spaced from said first outer support;

a drive wheel connected to said first outer support;

an idler wheel connected to said second outer support;

an elongated member circulated around said drive wheel and said idler wheel, wherein said elongated member is adapted for movement in an endless loop;

wherein said endless loop defines a figure-eight shape;

a power supply connected to said drive wheel for movement of said elongated member via rotation of said drive wheel; and at least one target connected to said elongated member, wherein said at least one target moves with said elongated member along said endless loop;

wherein said at least one target is pivotally connected to said elongated member;

wherein said target includes a first side including a first target portion and a second side including a second target portion;

wherein said target is adapted to flip over via gravity from said first side exposing said first target portion to said second side exposing said second target portion when changing from a first direction to a second direction.

3. The moving target system of claim 2, wherein said drive wheel and said idler wheel include a V-shaped groove to receive said elongated member.

4. The moving target system of claim 2, wherein said first direction is different than said second direction.

5. The moving target system of claim 2, wherein said first outer support and said second outer support are comprised of self-supporting structures.

6. The moving target system of claim 2, wherein said first outer support and said second outer support are comprised of telescoping structures.

7. The moving target system of claim 2, wherein said first outer support and said second outer support are comprised of substantially similar configurations.

8. The moving target system of claim 2, wherein said first outer support and said second outer support include a tripod configuration.

9. The moving target system of claim 2, including a control system electrically connected to said power supply.

10. The moving target system of claim 9, wherein said control system is adapted to change a speed of said elongated member.

* * * * *